US012644404B2

(12) United States Patent
Yamada et al.

(10) Patent No.: US 12,644,404 B2
(45) Date of Patent: Jun. 2, 2026

(54) DRAINAGE STRUCTURE FOR COOLING WATER

(71) Applicant: SUZUKI MOTOR CORPORATION, Hamamatsu (JP)

(72) Inventors: Shinichi Yamada, Hamamatsu (JP); Kentaro Ikeda, Hamamatsu (JP)

(73) Assignee: SUZUKI MOTOR CORPORATION, Hamamatsu (JP)

( * ) Notice: Subject to any disclaimer, the term of this patent is extended or adjusted under 35 U.S.C. 154(b) by 0 days.

(21) Appl. No.: 19/018,709

(22) Filed: Jan. 13, 2025

(65) Prior Publication Data

US 2025/0243797 A1 Jul. 31, 2025

(30) Foreign Application Priority Data

Jan. 26, 2024 (JP) ..... 2024-010024

(51) Int. Cl.
*F01P 3/02* (2006.01)
*F01P 5/10* (2006.01)

(52) U.S. Cl.
CPC ..... *F01P 3/02* (2013.01); *F01P 2003/024* (2013.01); *F01P 2050/16* (2013.01)

(58) Field of Classification Search
CPC ..... F01P 3/02; F01P 5/10; F01P 11/02; F01P 11/0279; F01P 2003/024; F01P 2050/16
See application file for complete search history.

(56) References Cited

U.S. PATENT DOCUMENTS 6,257,192 B1 * 7/2001 Yamaura ..... F02B 61/02 123/196 R
9,010,283 B2 * 4/2015 Nagata ..... F01P 3/02 123/41.44
11,408,328 B2 * 8/2022 Tayama ..... F01P 5/10
2010/0294216 A1 * 11/2010 Keene ..... F04D 29/426 123/41.44
2013/0064648 A1 * 3/2013 Chiba ..... F04D 29/106 415/168.2

FOREIGN PATENT DOCUMENTS

JP 3558164 B2 5/2004
JP 2014185616 A * 10/2014

* cited by examiner

*Primary Examiner* — Grant Moubry
(74) *Attorney, Agent, or Firm* — Stein IP, LLC

(57) ABSTRACT

A drainage structure for cooling water, includes: an engine cover attached to a crankcase; and a water pump attached to the engine cover. The water pump is provided with a seal member configured to seal a pump chamber, and is formed with a drain hole for draining cooling water leaking from the seal member. The engine cover is formed with a drain passage for guiding cooling water from the drain hole to a lower surface of the engine cover, and a covering portion that extends from the lower surface of the engine cover and that covers a space below an outlet of the drain passage. The covering portion includes a side wall that covers the space below the outlet from an outside in a vehicle width direction and a bottom wall that covers the space below the outlet from below.

8 Claims, 8 Drawing Sheets

DRAINAGE STRUCTURE FOR COOLING WATER

CROSS-REFERENCE TO RELATED APPLICATION(S)

This application is based on and claims priority under 35 USC 119 from Japanese Patent Application No. 2024-010024 filed on Jan. 26, 2024, the entire content of which is incorporated herein by reference.

TECHNICAL FIELD

The present invention relates to a drainage structure for cooling water.

BACKGROUND ART

In general, in a water-cooled engine, a circulation flow passage is formed in which the cooling water from a water pump returns to the water pump via a water jacket in a cylinder and a radiator. Although a mechanical seal is attached to the water pump, it is difficult to completely prevent water leakage from the water pump using only the mechanical seal. Therefore, the water pump is provided with a drainage structure for cooling water that leaks from the mechanical seal (for example, see Patent Literature 1). A drain hole is formed in a pump case of the water pump described in Patent Literature 1, and the cooling water that leaks from the mechanical seal is drained to the outside of the case through the drain hole.

CITATION LIST

Patent Literature

Patent Literature 1: JP3558164B

However, in the water pump described in Patent Literature 1, there is a problem that the cooling water is drained from the drain hole and adheres to the engine case and the cover, and the appearance of the engine deteriorates due to the precipitate of the cooling water.

SUMMARY

The present invention has been made in view of the above problems, and an object of the present invention is to provide a drainage structure for cooling water capable of preventing deterioration in appearance of an engine due to adhesion of the precipitate of the cooling water.

A drainage structure for cooling water according to an aspect of the present invention for solving the problem described above is a drainage structure for cooling water including: an engine cover that is attached to a crankcase; and a water pump that is attached to the engine cover, in which the water pump is provided with a seal member configured to seal a pump chamber, and is formed with a drain hole for draining cooling water leaking from the seal member, in which the engine cover is formed with a drain passage for guiding cooling water from the drain hole to a lower surface of the engine cover, and a covering portion that extends from the lower surface of the engine cover and that covers a space below an outlet of the drain passage, and in which the covering portion includes a side wall that covers the space below the outlet from an outside in a vehicle width direction and a bottom wall that covers the space below the outlet from below.

According to the drainage structure for cooling water in the aspect of the present invention, when water leakage occurs in the seal member of the water pump, the cooling water is guided from the drain hole of the water pump to the outlet of the drain passage. Although the cooling water is drained from the outlet of the drain passage, the cooling water is received by the side wall and the bottom wall of the covering portion, and the cooling water is less likely to spread along the outside of the engine cover. When the engine is running, the cooling water in the covering portion is easily evaporated by the heat of the engine. Therefore, even when the water pump is attached to the engine cover, the water leakage from the water pump is concealed by the covering portion and the appearance of the engine does not deteriorate. Since the covering portion extends from the lower surface of the engine cover, the covering portion is not noticeable and the cooling water is less likely to adhere to the other components.

DESCRIPTION OF EMBODIMENTS

In an engine according to an aspect of the present invention, an engine cover is attached to a crankcase, and a water pump is attached to the engine cover. In a drainage structure for cooling water, a seal member is attached to the water pump to seal a pump chamber, and the cooling water leaking from the seal member is drained from a drain hole of the water pump. A drain passage of the engine cover guides the cooling water from the drain hole to the lower surface of the engine cover, and a space below an outlet of the drain passage is covered by a covering portion that extends from the lower surface of the engine cover. The space below the outlet is covered by a side wall of the covering portion from the outside in the vehicle width direction, and the space below the outlet is covered by a bottom wall of the covering portion from below. When water leakage occurs in the seal member of the water pump, the cooling water is guided from the drain hole of the water pump to the outlet of the drain passage. Although the cooling water is drained from the outlet of the drain passage, the cooling water is received by the side wall and the bottom wall of the covering portion, and the cooling water is less likely to spread along the outside of the engine cover. When the engine is running, the cooling water in the covering portion is easily evaporated by the heat of the engine. Therefore, even when the water pump is attached to the engine cover, the water leakage from the water pump is concealed by the covering portion and the appearance of the engine does not deteriorate. Since the covering portion extends from the lower surface of the engine cover, the covering portion is not noticeable and the cooling water is less likely to adhere to the other components.

EMBODIMENT

Figure 1:
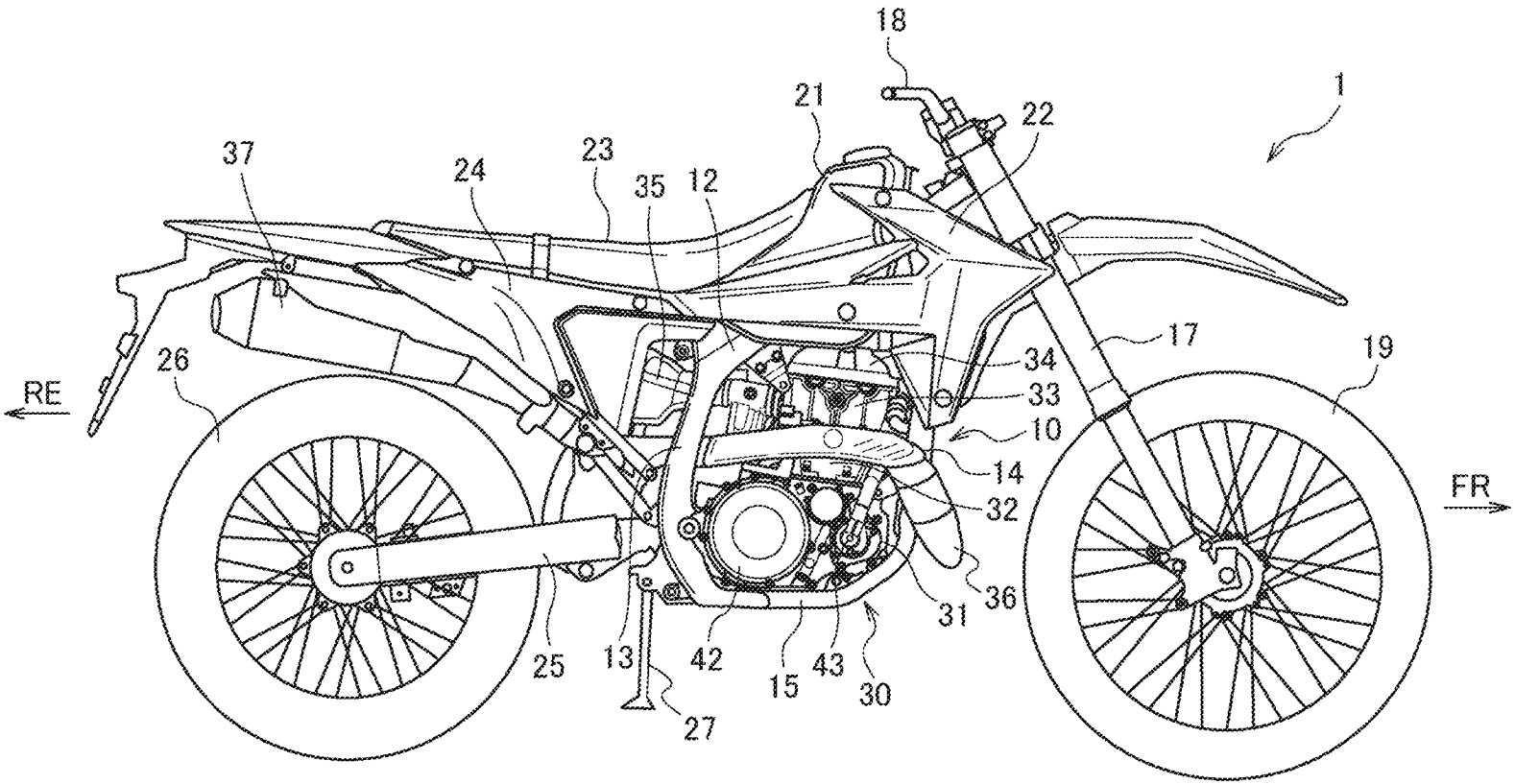
FIG. 1 is a right side view of a straddle-type vehicle according to an embodiment.

A straddle-type vehicle provided with a drainage structure for cooling water according to the present embodiment will be described below with reference to the accompanying drawings. FIG. 1 is a right side view of the straddle-type vehicle according to the present embodiment. In the following drawings, an arrow FR indicates a vehicle front side, an arrow RE indicates a vehicle rear side, an arrow L indicates a vehicle left side, and an arrow R indicates a vehicle right side.

As shown in FIG. 1, a straddle-type vehicle 1 is implemented by mounting various components such as an engine 30 and an electrical system on a vehicle body frame 10. A pair of main frames 12 extend obliquely rearward and downward from a head pipe (not shown) of the vehicle body frame 10, and the rear portions of the pair of main frames 12 form a pair of body frames 13 bent downward. A down frame 14 extends downward from the head pipe, and an under loop 15 bent rearward is connected to the lower portion of the down frame 14. The rear end portions of the pair of under loops 15 are connected to the lower portions of the pair of body frames 13, so that the vehicle body frame 10 is formed into a cradle shape.

A front fork 17 is steerably supported on the head pipe via a steering shaft (not shown). A handlebar 18 is provided on the upper portion of the front fork 17, and a front wheel 19 is rotatably supported on the lower portion of the front fork 17. A fuel tank 21 is placed over the upper portions of the pair of main frames 12, and the main frames 12 and the fuel tank 21 are covered by front side covers 22 from the lateral sides. A seat 23 is provided rearward of the fuel tank 21, and a seat frame (not shown) supporting the seat 23 from below is covered from the lateral sides by rear side covers 24.

A swing arm 25 is swingably supported on the body frame 13. The swing arm 25 extends rearward from the body frame 13, and a rear wheel 26 is rotatably supported at the rear end portion of the swing arm 25. The engine 30 is a four-stroke single-cylinder engine, and is suspended inside the vehicle body frame 10 via a plurality of suspension brackets. A cylinder assembly in which a cylinder 32, a cylinder head 33, and a cylinder head cover 34 are stacked is attached to the upper portion of a crankcase 31 of the engine 30. An air cleaner 35 is provided rearward of the cylinder head 33.

An exhaust pipe 36 extends downward from the left side of the front surface of the cylinder head 33, and the exhaust pipe 36 passes through the right lateral side of the cylinder 32 and is connected to a muffler 37 on the vehicle rear side. Left and right radiators (not shown) are attached to the front of the cylinder head 33. A clutch cover 42 is attached to the right side surface of the crankcase 31, and a water pump 43 is attached to the outer surface of the clutch cover 42. The cooling water is delivered from the water pump 43 to the cooling passage in the crankcase 31, and the cooling water is returned to the water pump 43 via the water jackets in the cylinder 32 and the cylinder head 33 and the radiator.

However, in a typical water pump, the pump chamber is sealed with a mechanical seal, but it is difficult to completely prevent water leakage using only a mechanical seal. Therefore, a drain hole is formed in the water pump, and a drain passage that communicates with the drain hole is formed in the clutch cover. When the cooling water leaks from the mechanical seal of the water pump, the cooling water enters the drain passage of the clutch cover through the drain hole of the water pump, and is drained to the outside of the clutch cover through the outlet of the drain passage. However, when the cooling water flows along the outside of the clutch cover, the precipitate of the cooling water adheres to the clutch cover, and the appearance of the engine deteriorates.

In this case, a configuration is conceivable in which a nipple is attached to the outlet of the drain passage to extend the hose from the nipple to the lower side of the engine. However, this requires the nipple, the hose, and the like, increasing the number of components and the cost. Depending on the configuration of the engine and the frame, the nipple may interfere with the frame and be damaged when the engine is provided, and the nipple may be damaged by being hit by a flying stone. In order to prevent the nipple from being damaged, a configuration is conceivable in which the distal end of the nipple is directed inward in the vehicle width direction from the clutch cover. However, this would require bending the drain passage inside the clutch cover, increasing the number of processing steps and requiring a blind plug or the like, which increases the cost.

Therefore, in the water pump 43 according to the present embodiment, instead of providing a nipple at the outlet of the drain passage, a covering portion 71 (see FIG. 2) extends from the clutch cover 42 so as to cover the space below the outlet of the drain passage. The cooling water is drained from the outlet of the drain passage inside the clutch cover 42 to the inside of the covering portion 71, and if the amount of cooling water is small, the cooling water is stored inside the covering portion 71 and evaporated by the heat of the engine 30. Therefore, even if the water pump 43 is attached to the clutch cover 42, the cooling water is less likely to spread along the outside of the clutch cover 42, and the appearance of the engine does not deteriorate due to the precipitate of the cooling water or the like.

Figure 2:
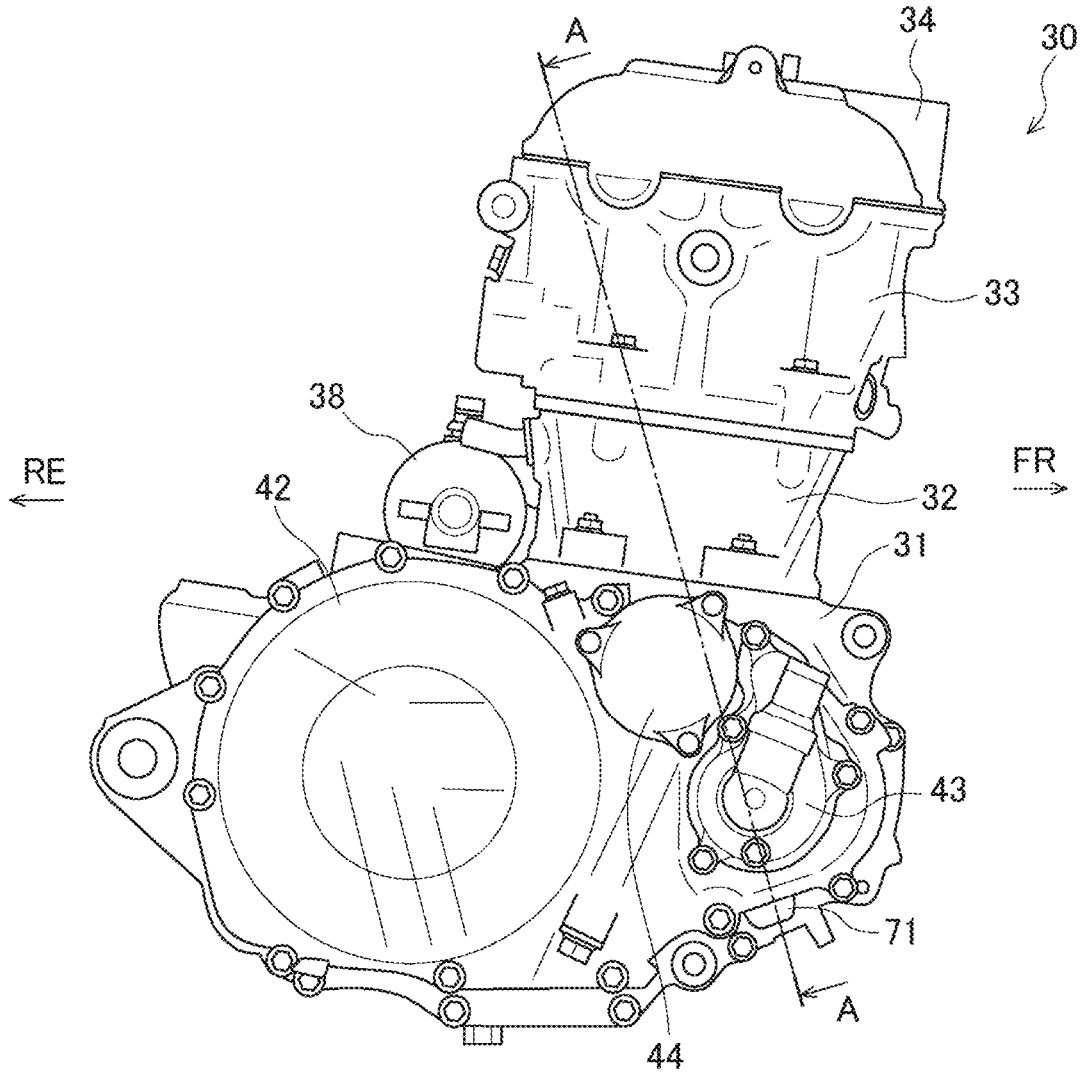
FIG. 2 is a right side view of an engine according to the present embodiment.
Figure 3:
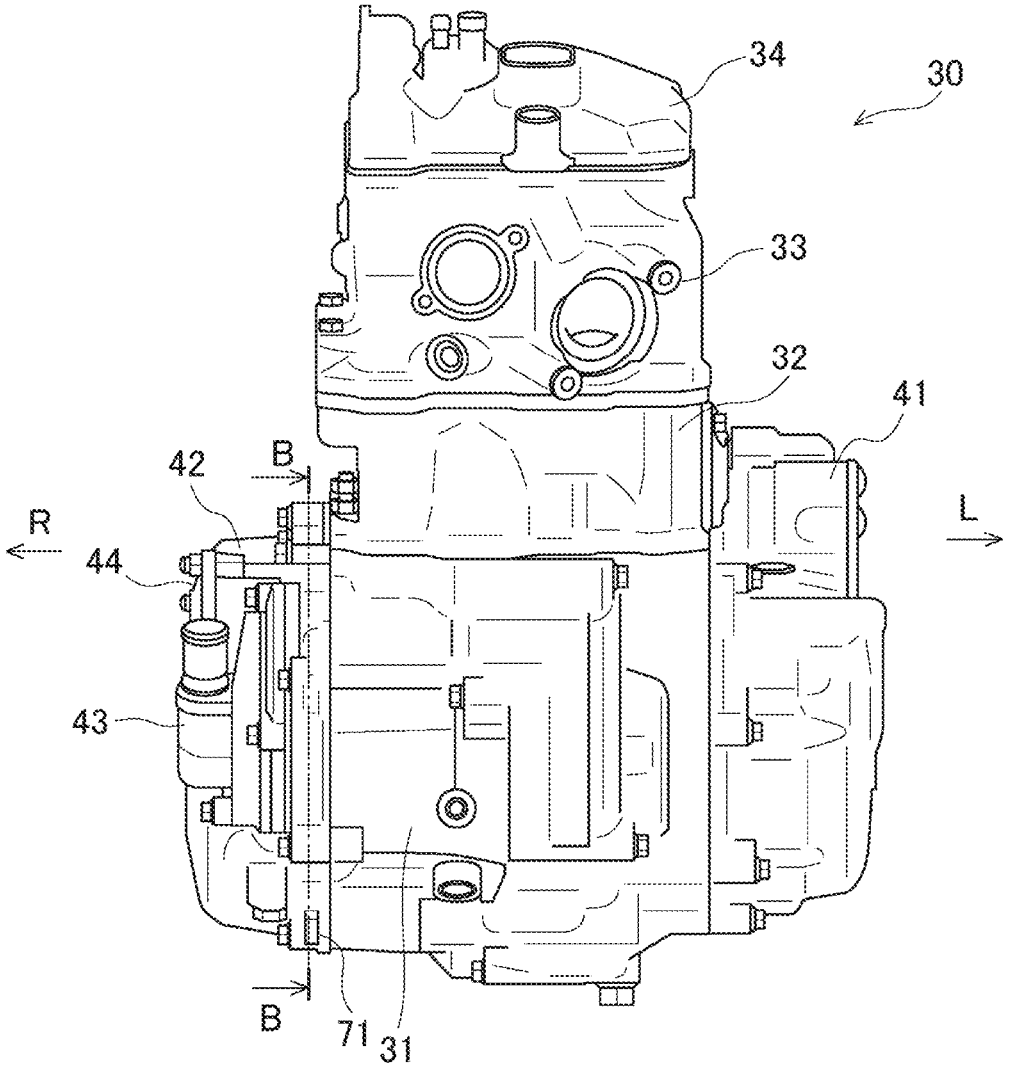
FIG. 3 is a front view of the engine according to the present embodiment.
Figure 4:
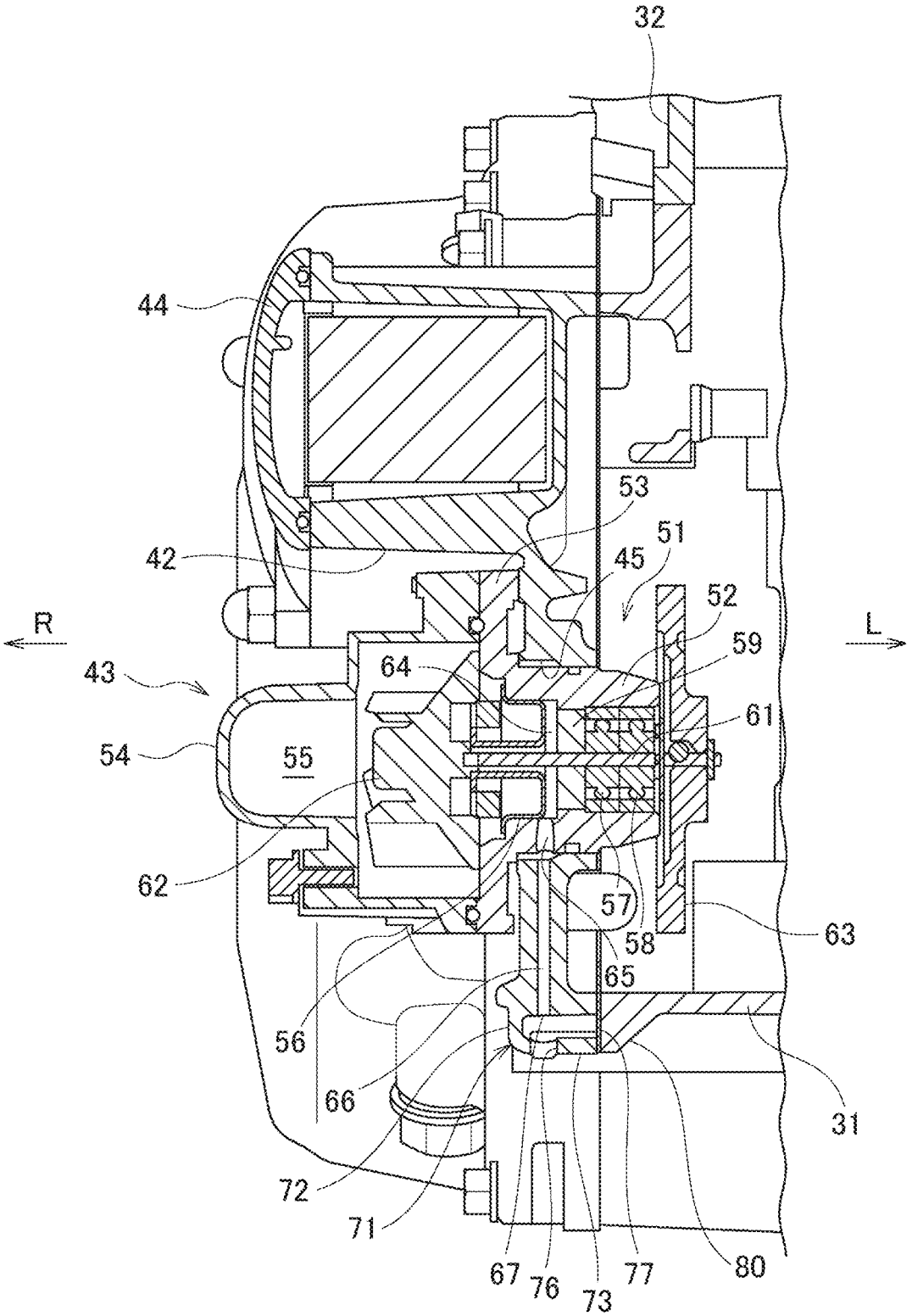
FIG. 4 is a cross-sectional view of the engine in FIG. 2 taken along a line A-A.
Figure 5:
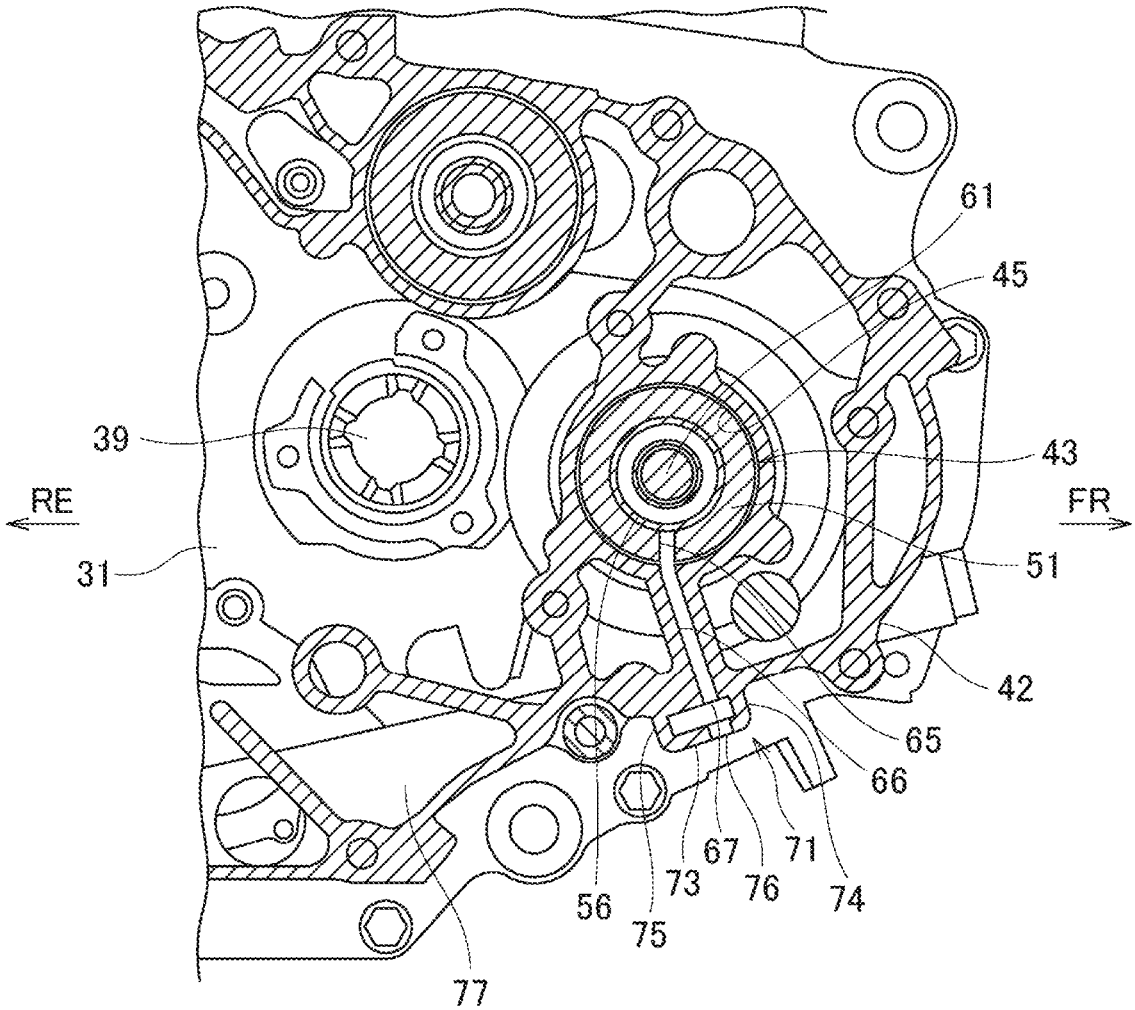
FIG. 5 is a cross-sectional view of the engine in FIG. 3 taken along a line B-B.

The engine according to the present embodiment will be described with reference to FIGS. 2 to 5. FIG. 2 is a right side view of the engine according to the present embodiment. FIG. 3 is a front view of the engine according to the present embodiment. FIG. 4 is a cross-sectional view of the engine in FIG. 2 taken along a line A-A. FIG. 5 is a cross-sectional view of the engine in FIG. 3 taken along a line B-B.

As shown in FIGS. 2 and 3, the engine 30 includes the crankcase 31 that has a left-right split structure constituted by a pair of left and right half cases. The cylinder 32 is attached to the upper surface of the crankcase 31, the cylinder head 33 is attached to the upper surface of the cylinder 32, and the cylinder head cover 34 is attached to the upper surface of the cylinder head 33. A starter motor 38 is attached to the upper surface of the crankcase 31 rearward of the cylinder 32. A magnet cover 41 is attached to the left side surface of the crankcase 31, and the clutch cover (the engine cover) 42 is attached to the right side surface of the crankcase 31.

The rear half portion of the clutch cover 42 bulges outward in the vehicle width direction into a cylindrical shape, and the front half portion of the clutch cover 42 has an upper-lower dimension that decreases toward the front side. The upper surface of the front half portion of the clutch cover 42 is inclined downward toward the front side, and the lower surface of the front half portion of the clutch cover 42 is inclined upward toward the front side. An oil filter cover 44 and the water pump 43 are attached to the outer surface of the front half portion of the clutch cover 42. The lower surface of the clutch cover 42 is inclined below the water pump 43, and the covering portion 71 to be described later extends downward from the inclined surface of the clutch cover 42.

As shown in FIGS. 4 and 5, a pump case 51 of the water pump 43 is fixed to a mounting hole 45 of the clutch cover 42. A cylindrical portion 52 of the pump case 51 is inserted inside the clutch cover 42, and a flange portion 53 of the pump case 51 is located outside the clutch cover 42. A pump cover 54 of the water pump 43 is attached to the flange portion 53 of the pump case 51, and the pump cover 54 and the flange portion 53 form a pump chamber 55 through which the cooling water flows. A mechanical seal (a seal member) 56 is mounted on the outer side of the cylindrical portion 52 of the pump case 51 in the vehicle width direction, and the pump chamber 55 is sealed by the mechanical seal 56.

A pair of bearings 57 and 58 are provided on the inner side of the cylindrical portion 52 of the pump case 51 in the vehicle width direction, and an impeller shaft 61 is rotatably supported on the pair of bearings 57 and 58. An oil seal 59 is attached to the intermediate portion of the cylindrical portion 52 of the pump case 51 in the vehicle width direction, and the oil seal 59 seals the gap between the impeller shaft 61 and the cylindrical portion 52. The impeller shaft 61 extends from the inside of the crankcase 31 into the pump chamber 55 through the inside of the mechanical seal 56. An impeller 62 is fixed to one end of the impeller shaft 61 in the pump chamber 55, and a gear 63 is fixed to the other end of the impeller shaft 61 in the crankcase 31.

A space 64 is formed between the mechanical seal 56 and the oil seal 59, and the cooling water that leaks from the mechanical seal 56 is received in the space 64. The leakage of the cooling water is only to the extent that the mechanical seal 56 seeps with the cooling water unless the mechanical seal 56 is damaged. A drain hole 65 that communicates with the space 64 is formed in the lower portion of the cylindrical portion 52 of the pump case 51, and the cooling water is drained through the drain hole 65 to prevent the cooling water from mixing with the oil. The impeller shaft 61 is positioned at substantially the same height as a crankshaft 39, and the clutch cover 42 is formed with a drain passage 66 that guides the cooling water from the drain hole 65 below the impeller shaft 61 to the lower surface of the clutch cover 42.

An outlet 67 of the drain passage 66 is opened in the lower surface of the clutch cover 42, and the covering portion 71 extends from the lower surface of the clutch cover 42 so as to cover the space below the outlet 67 of the drain passage 66. The cooling water is received by the covering portion 71, so that the cooling water is less likely to spread along the clutch cover 42. The covering portion 71 includes a side wall 72 that covers the lower space from the outside in the vehicle width direction, a bottom wall 73 that covers the lower space from the lower side, a front wall 74 that covers the lower space from the front side, and a rear wall 75 that covers the lower space from the rear side. By the lower surface of the clutch cover 42, the side wall 72, the bottom wall 73, the front wall 74, and the rear wall 75, the covering portion 71 is formed into a box shape in which the inner side surface on the inner side in the vehicle width direction is opened.

The clutch cover 42 is attached to the crankcase 31 via a gasket 77, and the opening on the inner side surface of the covering portion 71 is closed by the gasket 77 between the clutch cover 42 and the crankcase 31. In this case, a pressing portion 80 of the gasket 77 is formed at the lower portion of the crankcase 31 corresponding to the covering portion 71, and the gasket 77 is pressed against the covering portion 71 by the pressing portion 80 such that the lower space is blocked by the gasket 77 from the inner side in the vehicle width direction. The cooling water is received by the side wall 72, the bottom wall 73, the front wall 74, the rear wall 75, and the gasket 77 of the covering portion 71, and the cooling water is less likely to spread along the outer side of the clutch cover 42.

A drain hole 76 is formed in the bottom wall 73 of the covering portion 71, and the outlet 67 of the drain passage 66 and the drain hole 76 are located on a straight line. If the leakage is only to the extent that the mechanical seal 56 seeps with the cooling water, the cooling water is received by the covering portion 71. However, if the mechanical seal 56 is damaged and a large amount of water leaks, the water is drained from the drain hole 76. A malfunction of the mechanical seal 56 is recognized based on the amount of cooling water drained from the drain hole 76. The outlet 67 of the drain passage 66 and the drain hole 76 are located on a straight line, so that drainage can be smoothly performed. Further, the drain passage 66 and the drain hole 76 can be easily processed when the clutch cover 42 is manufactured.

Figure 6:
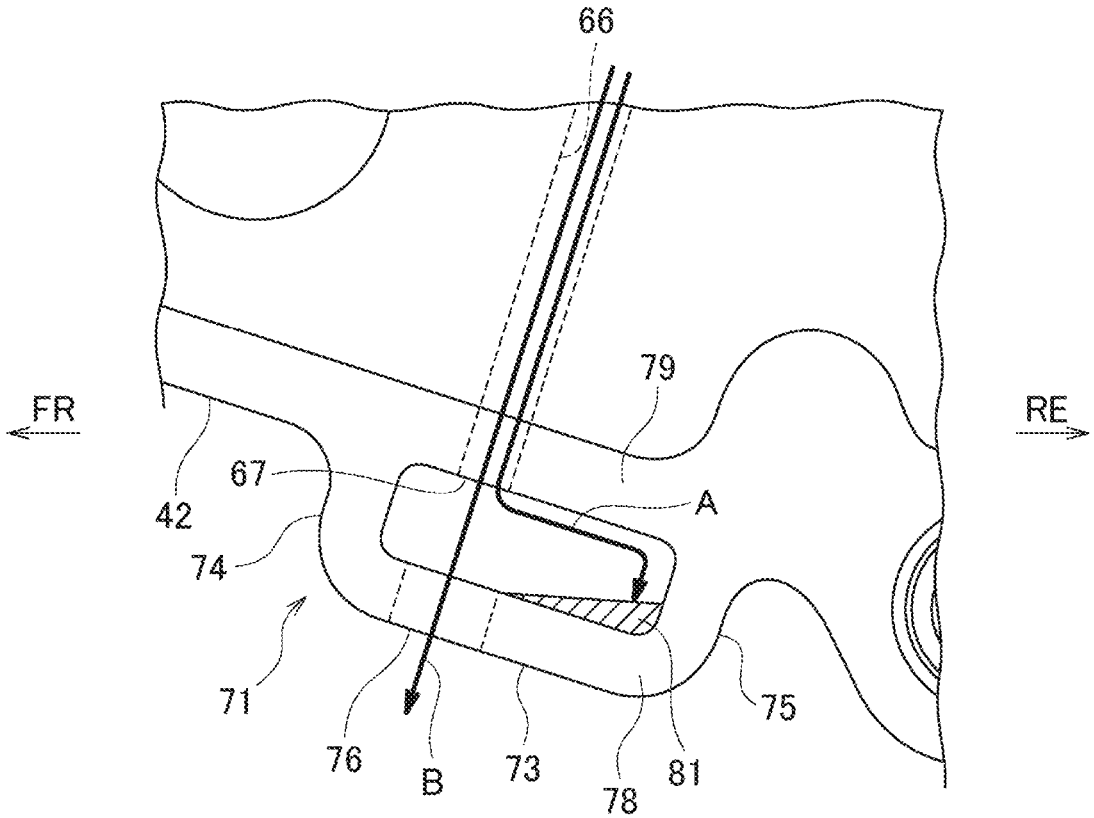
FIG. 6 is an enlarged view of the periphery of a covering portion according to the present embodiment.
Figure 7:
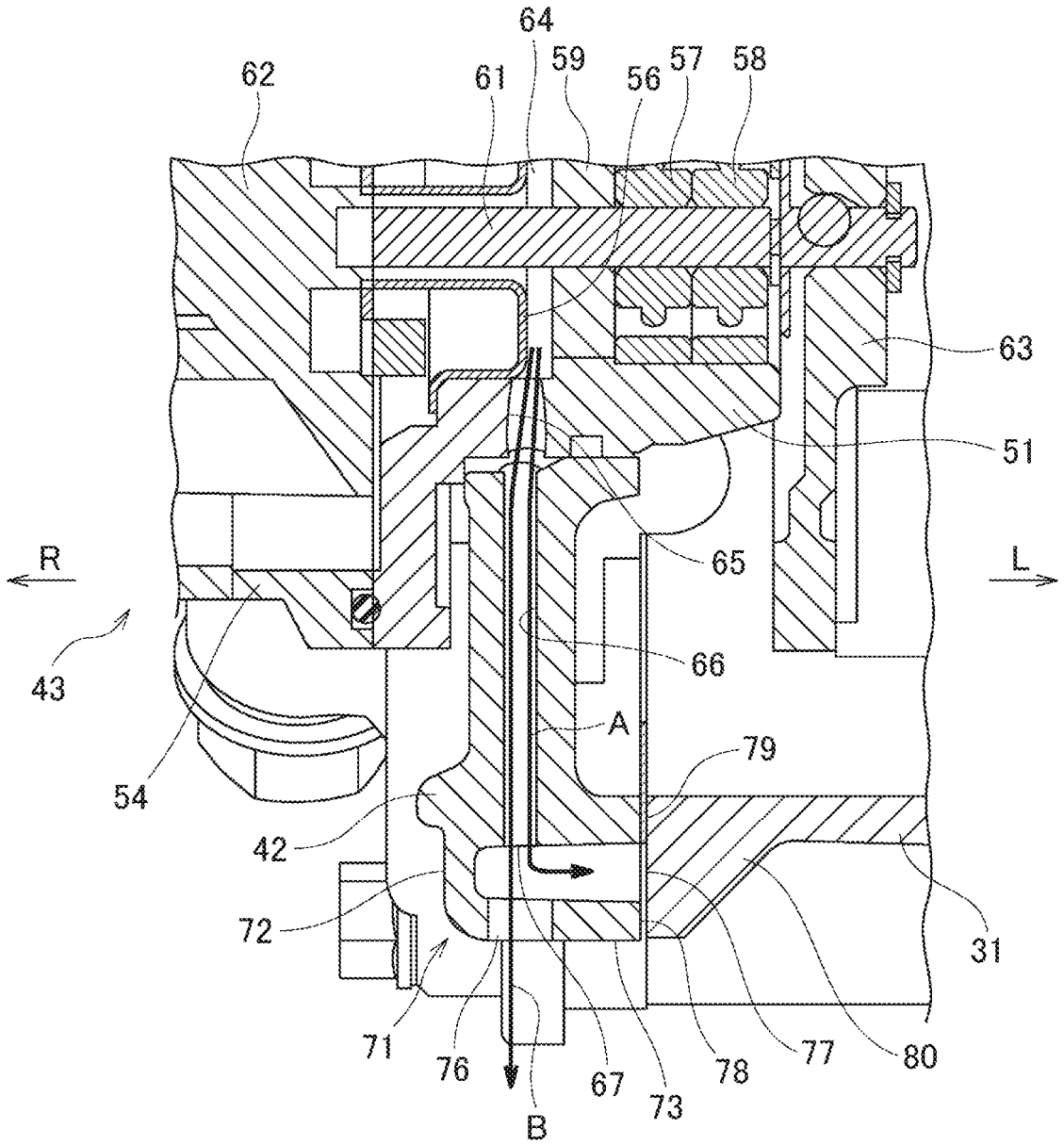
FIG. 7 is an explanatory view of a drainage path according to the present embodiment.

The drainage structure for cooling water will be described with reference to FIGS. 6 and 7. FIG. 6 is an enlarged view of the periphery of the covering portion according to the present embodiment. FIG. 7 is an explanatory view of a drainage path according to the present embodiment.

As shown in FIGS. 6 and 7, below the water pump 43, the lower surface of the clutch cover 42 is inclined so as to become higher toward the front side. The drain passage 66 linearly extends from the drain hole 65 of the water pump 43 to the lower surface of the clutch cover 42, and the covering portion 71 protrudes from the lower surface of the clutch cover 42 in the extending direction of the drain passage 66. The front wall 74 and the rear wall 75 of the covering portion 71 protrude vertically from the lower surface of the clutch cover 42, and the interval between the front wall 74 and the rear wall 75 is formed larger than the diameter of the outlet 67 of the drain passage 66. The covering portion 71 widely covers the space below the outlet 67 of the drain passage 66, making it easy to conceal water leakage.

The covering portion 71 extends in the vehicle width direction, and an end surface 78 of the covering portion 71 on the inner side in the vehicle width direction is formed flush with a mating surface 79 of the clutch cover 42 that fits against the crankcase 31. The cooling water that drips from the outlet 67 of the drain passage 66 is received by the covering portion 71, and the cooling water is less likely to spread along the outside of the clutch cover 42. The bottom wall 73 of the covering portion 71 is parallel to the lower surface of the clutch cover 42, and is inclined such that the bottom wall 73 becomes higher toward the front side. The drain hole 76 that is larger than the outlet 67 of the drain passage 66 is formed in the bottom wall 73 of the covering portion 71. The drain hole 76 is positioned on the extension line of the drain passage 66, and the drain hole 76 faces the outlet 67 of the drain passage 66.

When the lower surface of the clutch cover 42, which is the upper wall of the covering portion 71, is divided into a high side and a low side, the outlet 67 of the drain passage 66 is opened in the front half portion of the lower surface of the clutch cover 42, which is the high side of the lower surface. When the bottom wall 73 of the covering portion 71 is divided into a high side and a low side, the drain hole 76 is opened in the front half portion of the bottom wall 73, which is the high side of the bottom wall 73. The rear half portion of the covering portion 71, which is the lower side of the bottom wall 73, functions as a water receiver, and if the amount of water leakage from the mechanical seal 56 is small, the cooling water is stored in the rear half portion of the covering portion 71 and a liquid pool 81 is formed. When the engine is running, the heat of the engine causes the cooling water to evaporate, making it difficult for the cooling water to be drained to the lower surface of the clutch cover 42.

In the present embodiment, the water pump 43 and the clutch cover 42 are located on the right side of the vehicle body, and a side stand 27 (see FIG. 1) that inclines the vehicle body to support the vehicle body is located on the left side of the vehicle body. That is, the covering portion 71 that is formed on the clutch cover 42 is located on the side opposite to the side stand 27 in the vehicle width direction. Since the vehicle body is inclined to the left side when the vehicle is parked, the position of the covering portion 71 on the right side of the vehicle body becomes high, and the cooling water is less likely to be drained from the drain hole 76. Since the covering portion 71 is provided at the lower portion of the clutch cover 42, even if the vehicle body is inclined on the side stand 27 and the clutch cover 42 side becomes higher, the covering portion 71 is not noticeable and the appearance is improved.

In such a drain structure for cooling water, as indicated by an arrow A, when the mechanical seal 56 of the water pump 43 seeps with the cooling water, the cooling water enters the drain passage 66 from the space 64 of the mechanical seal 56 and the oil seal 59 through the drain hole 65. The cooling water flows from the outlet 67 of the drain passage 66 into the inside of the covering portion 71 along the lower surface of the clutch cover 42, and then flows along the side wall 72 and the rear wall 75 of the covering portion 71 and the wall surface of the gasket 77 to be stored in the rear half portion of the covering portion 71. Since the amount of water leaking from the mechanical seal 56 is small, even if the inclination of the bottom wall 73 is small, the water is not drained from the drain hole 76 and the liquid pool 81 is formed.

As indicated by an arrow B, when the mechanical seal 56 is damaged and a large amount of cooling water is drained, the cooling water flows into the drain passage 66 from the space 64 of the mechanical seal 56 and the oil seal 59 through the drain hole 65. The cooling water flows into the inside of the covering portion 71 from the outlet 67 of the drain passage 66, and a large amount of cooling water is drained from the drain hole 76 through the inside of the covering portion 71. At this time, the outlet 67 of the drain passage 66 and the drain hole 76 are arranged in a straight line, and the drain hole 76 is larger than the outlet 67 of the drain passage 66. Therefore, the cooling water is smoothly drained from the drain hole 76. A malfunction of the mechanical seal 56 can be recognized based on a large amount of drained cooling water.

As described above, according to the drainage structure for cooling water according to the present embodiment, when water leakage occurs in the mechanical seal 56 of the water pump 43, the cooling water enters the drain passage 66 from the drain hole 65 of the water pump 43. Although the cooling water is drained from the outlet 67 of the drain passage 66, the cooling water is received by the covering portion 71, and the cooling water is less likely to spread along the outside of the clutch cover 42. When the engine is running, the cooling water in the covering portion 71 is easily evaporated by the heat of the engine 30. Therefore, even if the water pump 43 is attached to the clutch cover 42, the water leakage from the water pump 43 is concealed by the covering portion 71 and the appearance of the engine 30 does not deteriorate. Since the covering portion 71 extends from the lower surface of the clutch cover 42, the covering portion 71 is not noticeable and the cooling water is less likely to adhere to the other components.

Figure 8:
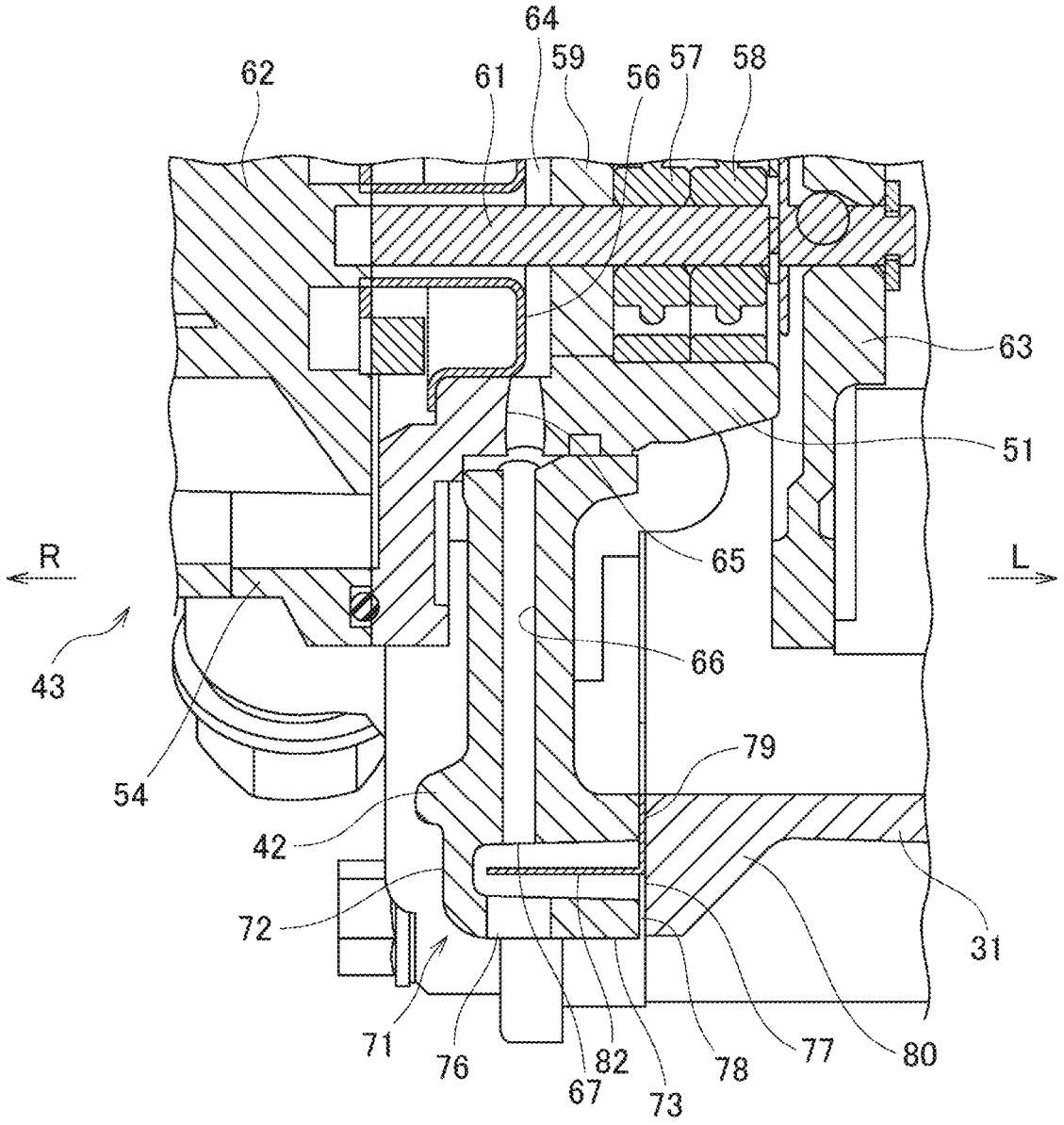
FIG. 8 is a view showing a drain structure for cooling water according to a comparative example.

As shown in a modification in FIG. 8, the gasket 77 may be folded to form a partition wall 82 that partitions the inside of the covering portion 71 into upper and lower parts, and the outlet 67 of the drain passage 66 may be covered from below by the partition wall 82 of the gasket 77. The cooling water that drips from the outlet 67 of the drain passage 66 is received by the partition wall 82 of the gasket 77, and a simple labyrinth structure is formed on the inside of the covering portion 71, making it difficult for the cooling water to be drained along the outside of the clutch cover 42.

In the present embodiment, the covering portion is formed in a box shape. Alternatively, the covering portion may have any shape as long as the covering portion is capable of covering the space below the outlet of the drain passage.

In the present embodiment, the outlet of the drain passage and the drain hole are arranged on a straight line. Alternatively, the outlet of the drain passage and the center of the drain hole may be offset from each other.

In the present embodiment, the side surface shape of the pressing portion may coincide with the side surface shape of the covering portion, or the side surface shape of the pressing portion may not coincide with the side surface shape of the covering portion. The pressing portion may be formed in any manner as long as the pressing portion is capable of pressing the gasket against the covering portion, and may be formed in a rib shape, for example.

The drainage structure for cooling water according to the present embodiment is not limited to the straddle-type vehicle described above, and may be used in other types of straddle-type vehicles. The straddle-type vehicle is not limited to a general vehicle in which a driver rides on a seat in a posture of straddling the seat, and includes a scooter-type vehicle in which the driver rides on the seat without straddling the seat.

As described above, a first aspect provides a drainage structure for cooling water including: an engine cover (a clutch cover 42) that is attached to a crankcase (31); and a water pump (43) that is attached to the engine cover, in which the water pump is provided with a seal member (a mechanical seal 56) configured to seal a pump chamber (55), and is formed with a drain hole (65) for draining cooling water leaking from the seal member, in which the engine cover is formed with a drain passage (66) for guiding cooling water from the drain hole to a lower surface of the engine cover, and a covering portion (71) that extends from the lower surface of the engine cover and that covers a space below an outlet (67) of the drain passage, and in which the covering portion includes a side wall (72) that covers the space below the outlet from an outside in a vehicle width direction and a bottom wall (73) that covers the space below the outlet from below. According to this configuration, when water leakage occurs in the seal member of the water pump, the cooling water enters the drain passage from the drain hole of the water pump. Although the cooling water is drained from the outlet of the drain passage, the cooling water is received by the side wall and the bottom wall of the covering portion, and the cooling water is less likely to spread along the outside of the engine cover. When the engine is running, the cooling water in the covering portion is easily evaporated by the heat of the engine. Therefore, even when the water pump is attached to the engine cover, the water leakage from the water pump is concealed by the covering portion and the appearance of the engine does not deteriorate. Since the covering portion extends from the lower surface of the engine cover, the covering portion is not noticeable and the cooling water is less likely to adhere to the other components.

A second aspect is directed to the first aspect, in which the covering portion includes a front wall (74) that covers the space below the outlet from a front side and a rear wall (75) that covers the space below the outlet from a rear side, and an interval between the front wall and the rear wall of the covering portion is formed larger than a diameter of the outlet of the drain passage. According to this configuration, the covering portion widely covers the space below the outlet of the drain passage, making it easy to conceal water leakage. The cooling water is received by the front wall and the rear wall of the covering portion, and the cooling water is less likely to spread along the outside of the engine cover.

A third aspect is directed to the first aspect or the second aspect, in which the covering portion extends in the vehicle width direction, and an end surface of the covering portion on an inner side in the vehicle width direction is formed flush with a mating surface of the engine cover that fits against the crankcase. According to this configuration, the cooling water that drips from the outlet of the drain passage is received by the bottom wall of the covering portion, and the cooling water is less likely to spread along the outside of the engine cover.

A fourth aspect is directed to any one of the first to third aspects, in which the engine cover is attached to the crankcase via a gasket (77), and in which the gasket is pressed against the covering portion such that the space below the outlet is blocked by the gasket from an inner side in the vehicle width direction. According to this configuration, the cooling water that drips from the outlet of the drain passage is received by the gasket, and the cooling water is less likely to spread along the outside of the engine cover.

A fifth aspect is directed to any one of the first to fourth aspects, in which a drain hole is formed in the bottom wall of the covering portion, and the outlet of the drain passage and the drain hole are arranged on a straight line. According to this configuration, if the mechanical seal is damaged and a large amount of water leaks, the water is drained from the drain hole, and a malfunction of the mechanical seal is recognized based on the amount of cooling water drained from the drain hole. The outlet of the drain passage and the drain hole are located on a straight line, so that drainage can be smoothly performed. Further, the drain passage and the drain hole can be easily processed when the engine cover is manufactured.

A sixth aspect is directed to the fifth aspect, in which when the bottom wall of the covering portion is divided into a high side and a low side, the drain hole is opened to the high side of the bottom wall of the covering portion. According to this configuration, the cooling water is likely to accumulate inside the covering portion, and when the engine is running, the heat from the engine causes the cooling water inside the covering portion to evaporate, making it difficult for the cooling water to be drained to the engine cover.

A seventh aspect is directed to any one of the first to sixth aspects, in which the covering portion is located on a side opposite to, in the vehicle width direction, a side stand (27) that inclines a vehicle body to support the vehicle body. According to this configuration, the cooling water is less likely to leak from the covering portion when the vehicle is parked. Since the covering portion is provided at the lower portion of the engine cover, even if the vehicle body is inclined on the side stand and the engine cover side becomes higher, the covering portion is not noticeable and the appearance is improved.

An eighth aspect is directed to any one of the first to seventh aspects, in which the engine cover is attached to the crankcase via a gasket, and the gasket is folded to form a partition wall (82) that partitions an inside of the covering portion into upper and lower parts, and the outlet of the drain passage is covered from below by the partition wall of the gasket. According to this configuration, the cooling water that drips from the outlet of the drain passage is received by the partition wall of the gasket, and a simple labyrinth structure is formed on the inside of the covering portion, making it difficult for the cooling water to be drained along the outside of the engine cover.

Although the present embodiment has been described, a part or all of the embodiment and modifications described above may be combined as another embodiment.

The technique according to the present invention is not limited to the embodiment described above, and may be variously changed, replaced, or modified without departing from the gist of the technical concept. Further, the present invention may be implemented by other methods as long as the technical concept can be implemented by the methods through advance of the technique or other derivative techniques. Therefore, the claims cover all embodiments that may fall within the scope of the technical concept.

The invention claimed is:

1. A drainage structure for cooling water comprising:

an engine cover attached to a crankcase; and a water pump attached to the engine cover, wherein the water pump is provided with a seal member configured to seal a pump chamber, and is formed with a drain hole for draining cooling water leaking from the seal member, wherein the engine cover is formed with a drain passage for guiding cooling water from the drain hole to a lower surface of the engine cover, and a covering portion that extends from the lower surface of the engine cover and that covers a space below an outlet of the drain passage, and wherein the covering portion includes a side wall that covers the space below the outlet from an outside in a vehicle width direction and a bottom wall that covers the space below the outlet from below.

2. The drainage structure for cooling water according to claim 1, wherein the covering portion includes a front wall that covers the space below the outlet from a front side and a rear wall that covers the space below the outlet from a rear side, and wherein an interval between the front wall and the rear wall of the covering portion is formed larger than a diameter of the outlet of the drain passage.

3. The drainage structure for cooling water according to claim 1, wherein the covering portion extends in the vehicle width direction, and an end surface of the covering portion on an inner side in the vehicle width direction is formed flush with a mating surface of the engine cover that fits against the crankcase.

4. The drainage structure for cooling water according to claim 1, wherein the engine cover is attached to the crankcase via a gasket, and wherein the gasket is pressed against the covering portion such that the space below the outlet is blocked by the gasket from an inner side in the vehicle width direction.

5. The drainage structure for cooling water according to claim 1, wherein a drain hole is formed in the bottom wall of the covering portion, and the outlet of the drain passage and the drain hole are arranged on a straight line.

6. The drainage structure for cooling water according to claim 5, wherein when the bottom wall of the covering portion is divided into a high side and a low side, the drain hole is opened to the high side of the bottom wall of the covering portion.

7. The drainage structure for cooling water according to claim 1, wherein the covering portion is located on a side opposite to, in the vehicle width direction, a side stand that inclines a vehicle body to support the vehicle body.

8. The drainage structure for cooling water according to claim 1, wherein the engine cover is attached to the crankcase via a gasket, and wherein the gasket is folded to form a partition wall that partitions an inside of the covering portion into upper and lower parts, and the outlet of the drain passage is covered from below by the partition wall of the gasket.

* * * * *